US007796774B2

(12) United States Patent
Albert

(10) Patent No.: US 7,796,774 B2
(45) Date of Patent: Sep. 14, 2010

(54) PORTABLE MUSICAL INSTRUMENT AMPLIFIER

(76) Inventor: Neil Fredrick Albert, 2600 Netherland Ave., Apt. 2609, Bronx, NY (US) 10463

( * ) Notice: Subject to any disclaimer, the term of this patent is extended or adjusted under 35 U.S.C. 154(b) by 1196 days.

(21) Appl. No.: 10/886,316

(22) Filed: Jul. 7, 2004

(65) Prior Publication Data

US 2005/0053256 A1 Mar. 10, 2005

Related U.S. Application Data

(60) Provisional application No. 60/485,209, filed on Jul. 7, 2003.

(51) Int. Cl.
*H04R 1/02* (2006.01)

(52) U.S. Cl. ..... 381/386; 381/345; 381/337; 181/148

(58) Field of Classification Search ..... 381/150, 381/87, 118, 120, 332–336, 386, 345–354, 381/337; 181/144, 148, 157, 175
See application file for complete search history.

(56) References Cited

U.S. PATENT DOCUMENTS 3,767,004 A * 10/1973 Liebscher ..... 181/172
3,860,755 A * 1/1975 Kimbell et al. ..... 381/109
3,962,607 A * 6/1976 Burns ..... 361/89
4,179,009 A * 12/1979 Birkner ..... 181/171
4,237,341 A * 12/1980 Richards ..... 381/75
4,245,540 A * 1/1981 Groupp ..... 84/726
4,810,997 A * 3/1989 Kudo et al. ..... 340/384.6
5,847,922 A * 12/1998 Smith et al. ..... 361/683
5,875,255 A * 2/1999 Campbell ..... 381/345
6,307,947 B1 * 10/2001 Wiener ..... 381/386
6,487,297 B1 * 11/2002 Chin-Fa ..... 381/345
6,577,741 B1 * 6/2003 Basore ..... 381/386
6,661,898 B2 * 12/2003 Kuwabara ..... 381/87
7,158,648 B2 * 1/2007 Butters et al. ..... 381/160

* cited by examiner

*Primary Examiner*—Vivian Chin
*Assistant Examiner*—Fatimat O Olaniran

(57) ABSTRACT

In accordance with the invention is disclosed a portable speaker of exceptionally low bulk yet very good performance which incorporates a non-homogeneous enclosure shape consisting of two main parts, one shallow box-shaped housing section and one cylindrical housing section, and incorporating retractable legs for support of the housing on the ground or table on which it is placed during its operation. A much larger loudspeaker than would be otherwise possible can then be used in an enclosure of very small bulk. The box-shaped housing section is dedicated to housing only the frame/basket and concentric diaphragm of the speaker, which, together generally comprises only half the speakers total length where the other half of the speakers length, the magnet assembly, is enclosed by the cylindrical section. The cylinder is connected to the main box section and allows sound to flow around the magnet contained within it, and also provides both protection for magnetic media as well as serving as a physical anchor for the speaker at its magnet. This shallow box housing section also provides an ideal housing a large number of AA (UM3) batteries as well as and adequate housing for the electronic amplifier which powers the loudspeaker. The speaker diaphragm is oriented facing upward when the unit is placed with its legs resting on the ground or table, so that the exhaust of the cylinder is reflected off the ground serving to amplify and further increase decibel volume and bass from the tiny enclosure. The legs can be retracted for minimum bulk when the unit is not in use.

1 Claim, 3 Drawing Sheets

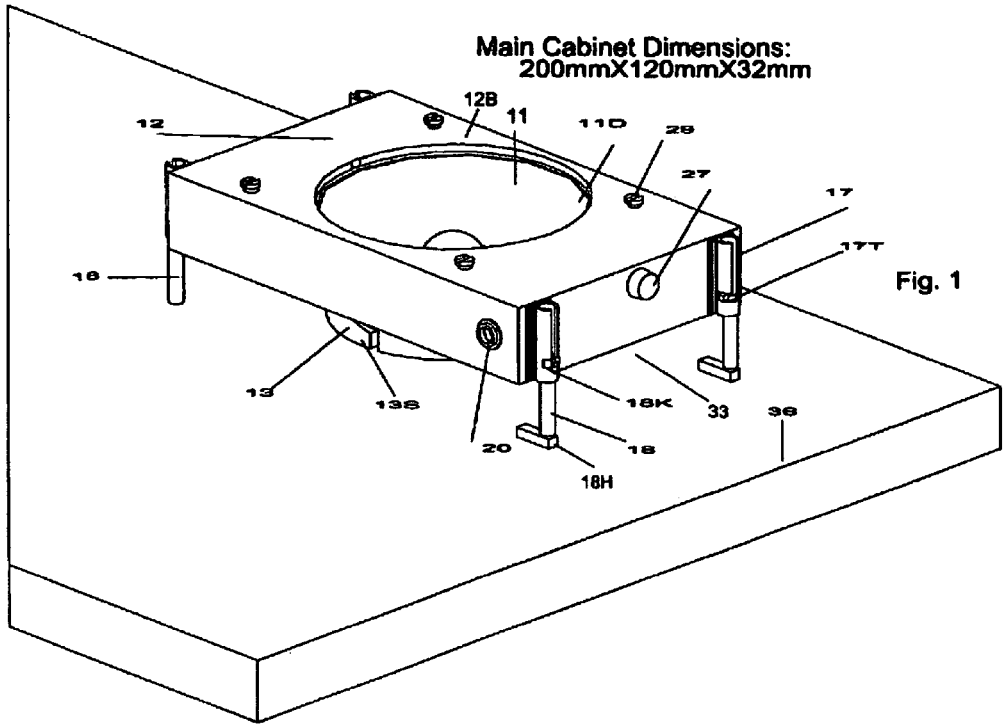
Fig. 1
Fig. 2
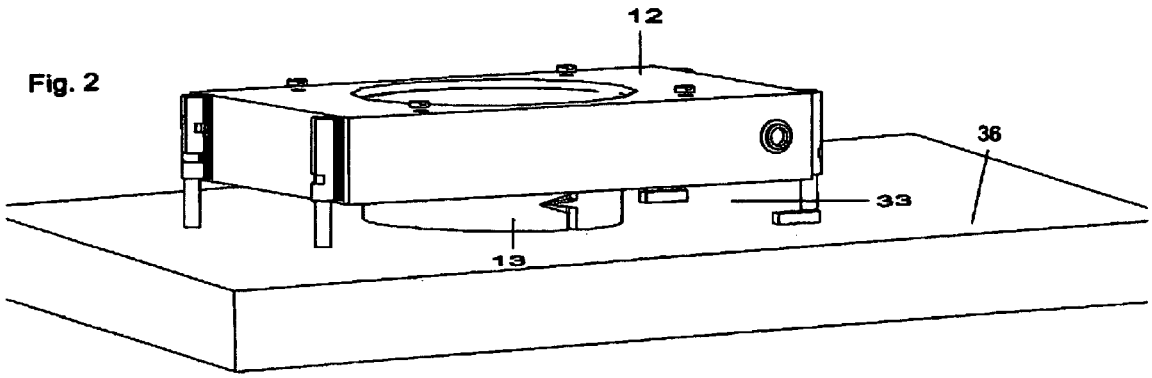

PORTABLE MUSICAL INSTRUMENT AMPLIFIER

CROSS REFERENCE TO RELATED APPLICATIONS

This application is based on provisional application Ser. No. 60/485,209, filed on Jul. 7, 2003.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

The applicant calls attention to the following prior Letters Patent, which is representative of the portable amplifier art:
Kimball U.S. Pat. No. 3,860,755 Jan. 14, 1975
Neil U.S. Pat. No. 3,126,450 Mar. 24, 1964
Staunton U.S. Pat. No. 1,953,135 Apr. 3, 1934
De Boer U.S. Pat. No. 2,610,694 Sep. 16, 1952
Peavey U.S. Pat. No. 3,151,699 Oct. 6, 1964
Round U.S. Pat. No. 1,904,537 Apr. 18, 1933
French Patent to 321,178 Apr. 30, 1957 Paillard, S.
Campbell U.S. Pat. No. 5,875,255 January 1981

Many musical instruments will benefit from some for of electronic amplification to be better heard in performance to a group of people in a variety of venues. Several very popular modern instruments, such as the electric guitar, produce very little sound at all without some kind of electronic amplification and are intended for use with an amplified speaker. The variety and selection of amplification gear for musical instruments is vast with most of these being ones that require an external power source, mains alternating current AC, and are also several to many times heavier than the musical instruments they are intended to amplify, since conveniently, this is the most effective way to assure great decibel volume, very good bass response and clear sound at their intended volume.

These amplified speakers, commonly called combo amplifiers, include a much more limited group which are much smaller, lighter, and also power by independent self-contained battery power source and are intended for maximum portability to a performance venues such as for street musicians or for easy transport for practicing ones instrument when no audience is intended. These incorporate a number of geometries for the housing enclosure which are either box-like or cylindrical, but few if any utilize and enclosure which deviates from a single homogenous 3 dimensional form encompasses all the internal components. They are generally scaled own versions of the original full-scale sound amplifying apparatus.

None of these will produce adequate bass response and volume to provide satisfactory rendition of the performance if scaled down to a size compact enough to fit easily in normal luggage or the accessory compartment of guitar carrying bag.

This disclosure deals with a novel housing, non-homogeneous in shape that achieves a comparable degree of performance from an amplified speaker that is even more compact and more easily carried.

BRIEF SUMMARY OF THE INVENTION

A number of geometries for the housing enclosure have been used to create highly portable self-contained amplified speakers for musical instrument performance which are either box-like or cylindrical, but invariably will encompass the entire all the internal components within its single homogenous 3 dimensional form. They are, most often, merely scaled own versions of the larger and heavier full-scale sound amplifying apparatus.

In accordance with the invention, a novel non-homogeneous overall housing shape is disclosed which incorporates 2 parts, consisting of one shallow box-shaped section and one internally ribbed cylindrical section. What is gained is achieved by having the shallow box-shaped main enclosure to not be required to house the entire length of the speaker, but rather only that length which comprises the speaker's frame/basket and diaphragm, an unusually large complement of batteries as well as the amplification electronics. The second, a cylindrical housing section, is used to enclose the magnet assembly of the speaker, which typically accounts for half the loudspeaker's total length. In addition this cylindrical housing section also serves as an acoustic port to channel additional sound energy to the volume of air trapped beneath the main housing section when the devices support means is adjusted to provide a small degree of clearance between the cylinder's exhaust end and the floor or table upon which the unit rests, and it may also be used to help support the weight of the oversize loudspeaker if it is allowed to come it contact with the speakers magnet.

Not normally a component of an amplified speaker's construction, legs are introduced to best utilize the operation of the novel enclosure when in use but which are retractable, allowing the unit's bulk to be reduced when not in use as for transporting and storage. This novel geometry allows a much larger, conventional loudspeaker than would be otherwise possible to be used in a device this small.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 is a perspective view.
FIG. 2 is a perspective view.

DETAILED DESCRIPTION OF THE PREFERRED EMBODIMENTS

Figure 3:
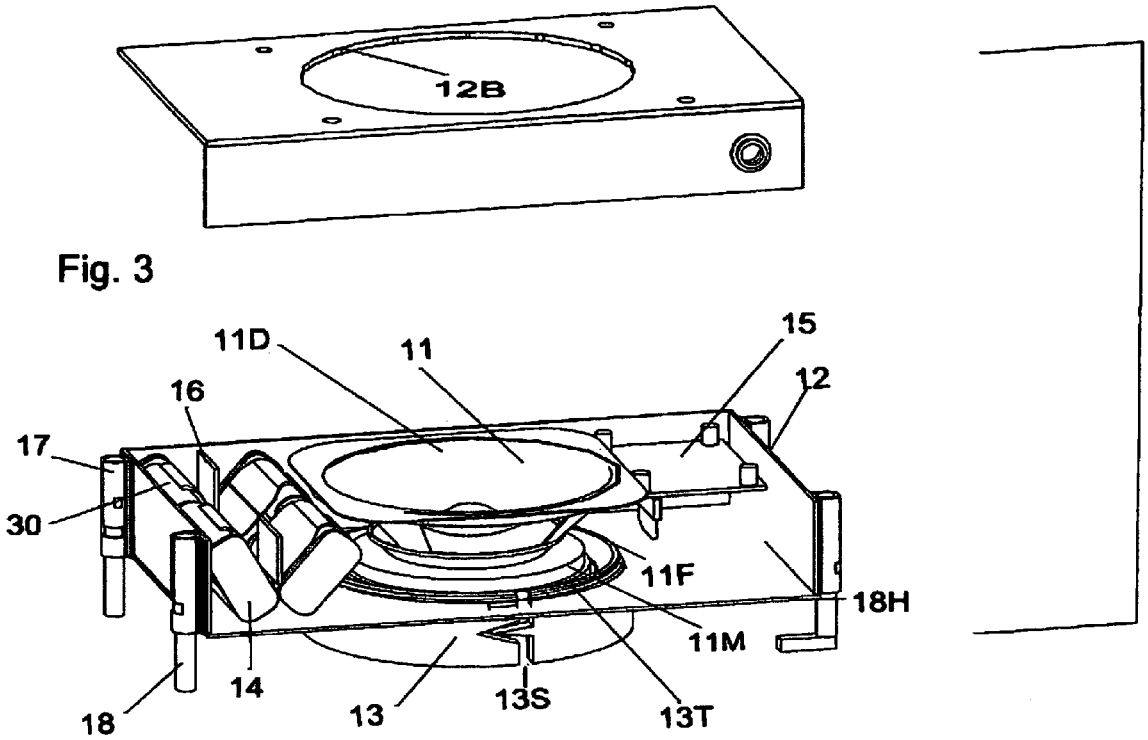
FIG. 3 is an exploded view
Figure 4:
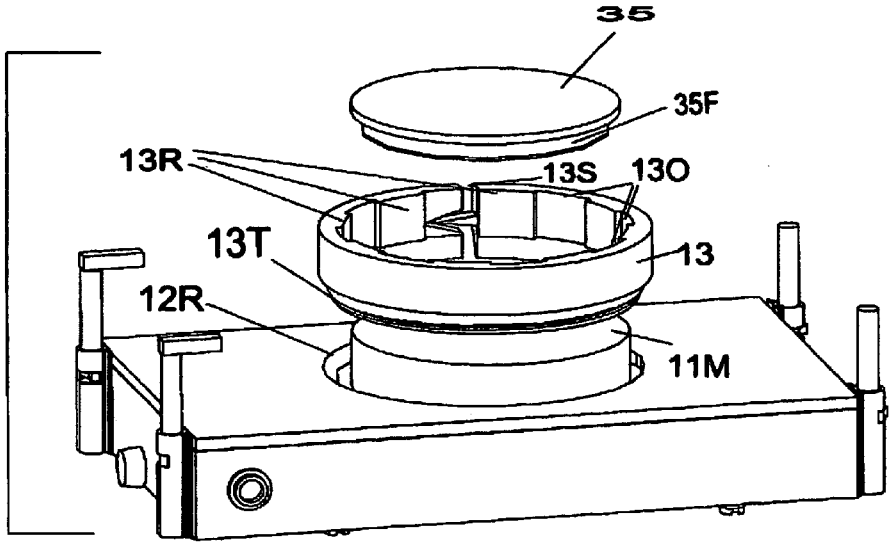
FIG. 4 is an exploded view.
Figure 5:
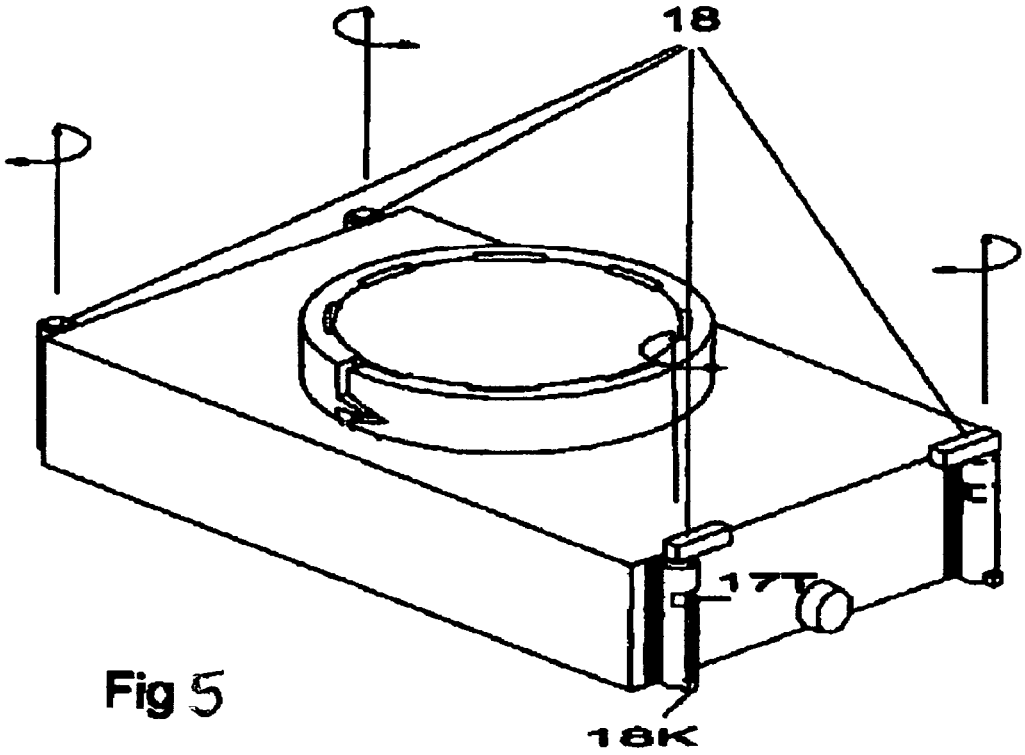
FIG. 5 is a perspective view illustrating the retractable legs
Figure 6:
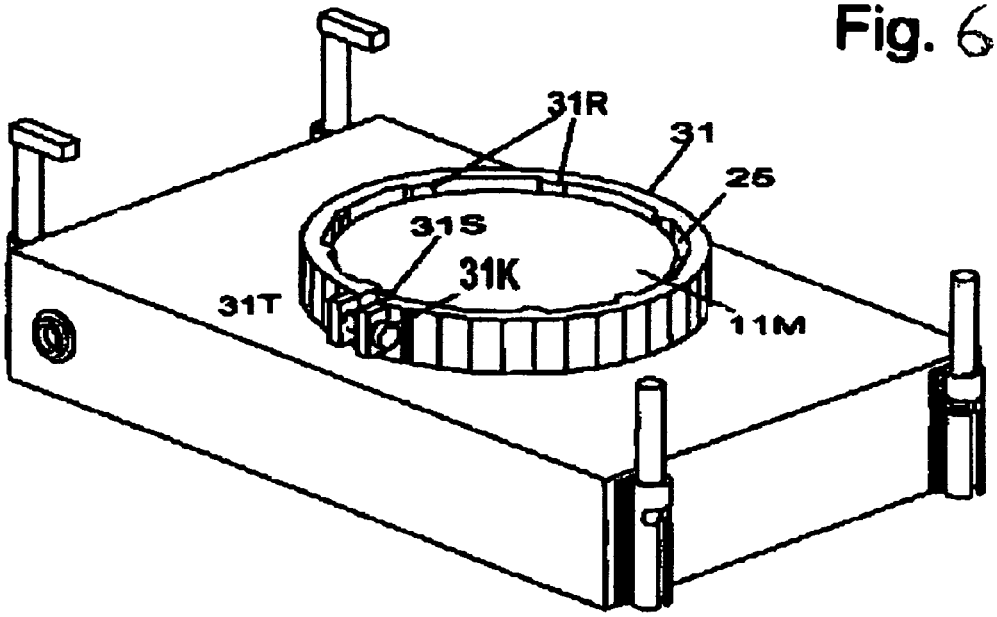
FIG. 6 is a perspective view showing an alternate embodiment of the cabinet extension.

Referring to FIGS. 1-6 this invention refers to a compact self-contained amplifier speaker unit which is comprised of two sections, the first, the main enclosure 12, which is the larger of the two sections has a length and width which are both substantially greater than its height. The proportions of length, width to height L,W,H, of the main enclosure 12 are such that, if H is between 0.5 and 1.5 then both L and W will be between 5 and 10. main enclosure 12 will be capable of housing amplifier electronics 15, battery supply 30, and about one half the length of a conventional loudspeaker 11. The loudspeaker is attached to the inner surface of one of the 2 large (L×W) panels, of the main enclosure by its mounting screws 29 at hole 12F. This first panel forms the speaker enclosure baffle (as described by Leo L. Beranek in *Acous-*

*tics*-McGraw Hill, 1954), and hole 12F will be approximately the same diameter as the speaker's diaphragm or consistent with the speaker manufacturer's recommendations. Another hole which is in the main enclosure's other large L×W panel has its center located such that an axis connecting the center of the 2 holes will be exactly perpendicular to both L×W planes and panels and this hole allows the speaker magnet assembly to pass completely through the main enclosure. The cylindrical housing section is attached to the main enclosure at this opposite panel at the second hole 12R.

One goal of this invention is to be able to utilize a speaker having a very large magnet 11M thus increasing the efficiency and performance. The force on a segment of wire of the speaker's voice coil for an amount of electrical current passed through it is given by dF=Idl×B, so if the magnetic field B is increased, the force F will increase, resulting in greater efficiency for a given amount of electrical current, I applied to the speaker. The invention described provides a way to do this with the least possible effect on the bulk of the total assembly.

The cylindrical housing section greatly contributes to this goal and by serving a variety of specific functions each of which will be described in the following paragraphs.

The first function of 13, an lengthwise internally ribbed slit cylinder, is to create a acoustically restrictive port extending from the box shaped main enclosure 12 to the device's external environment for the purpose of damping the volume of air internal to the main enclosure as well as to radiate additional sound energy to augment the direct sound radiation of the speaker diaphragm and to accomplish these functions with the least possible effect on the bulk of the assembly. In the preferred embodiment, the port 130 is created by the difference in the cross sectional area of the inner surface of tube 13 and the loudspeaker's magnet 11M outer surface diameter, as defined by the height and spacing of the cylinder's ribs 13R and this is accomplished by making the magnet and tube or exactly concentric and thereby share the same physical volume.

Another object of this tube 13 is to provide a physical barrier to prevent magnetic storage media safe from possible erasure by coming in direct contact with the magnet or merely too close. In the preferred embodiment the tube will be only 10-15% larger diameter than the speakers magnet. However, because, the magnetic field strength is proportional to the inverse of the square of the distance from the source of magnetism, a barrier of only moderate thickness will have an appreciable effect on the maximum magnetic field that media can be subjected to, since the inverse of distance squared becomes a small number fairly rapidly with increasing separation of the media from the magnet. This factor is important since the invention's small size means that it may be packed with other items in some kind of travel luggage. A rear cap 35, 35F is used to prevent contact with the end of the speaker magnet, which is not protected by cylinder 13 and would be otherwise exposed.

Another object of cylinder 13 is to accommodate the substantial manufacturing variation of the donut-shaped magnets use in loudspeaker construction which have their outer diameter shaped and sized by a process known as centerless grinding. This process is faster and less expensive than a process where the part is spun on a spindle, as in a lathe (turning) process, because the latter requires time to insert and remove the part from the spindle. As a result, the best tolerances that can be maintained, which are typically +=0.001 in, may not be suitable for close fit of the diameter with another part, which in this case is speaker magnet 11M. In normal application of a conventionally constructed loudspeaker cabinet this is almost never a problem, since a speaker's mechanical connection with its enclosure is at the front mounting flange only.

The expandable nature of the slit cylinder 13,13S, allows a precise fit to the loudspeaker magnet despite the manufacturing variations in the diameter of these parts. This also results in uniform cross sectional area of the air channels created between the speaker magnet 11M and the cylindrical tube's ribs 13R since the ribs are always forced to be in intimate contact with the outside diameter of magnet.

Another object is to provide a means to vary the acoustic characteristics of the enclosure. It can be easily removed by the player and replaced with one having different acoustic properties resulting from the cylinder 13 having different spacing between adjacent ribs 13R.

Another result is that the ribs 13R, whose adjacent spacing 130 create the desired acoustic resistance for cylinder 13 in its role as an acoustic port, also clamp the magnet circumference preventing the speaker basket from moving when the diaphragm vibrates. The rigidity that the ribbed cylinder contributes to the speaker's magnet and basket allows the cabinet baffle to be fabricated from a somewhat more flexible material, if desired, which can vibrate in sympathy to the diaphragm as the air pressure inside the cabinet fluctuates with the piston motion of the diaphragm, in a manner described previously described by Campbell.

Another function is that additional sound energy is forced through the passages of the cylinder 13O, and when the cabinet is oriented in the preferred stance, with the cylinder 13's opening facing the floor/table 36 upon which the unit's legs 18 are placed, this sound energy is reinforced by being reflected off that surface.

Another advantage of this configuration in that, since the surface area of the bottom of main cabinet is large and the distance between it and the floor is small (provided the speaker used has a short large diameter magnet rather than a long small diameter one) a high pressure area will tend be created underneath the main cabinet 12 effectively creating a virtual external chamber which then coupled to the air main enclosure's 12 chamber though the air passages between the cylinder ribs 13O. The resonant frequency of the combination of the internal chamber and the virtual external one created by the high pressure area under the cabinet will be different than that of that of internal chamber of the main enclosure 12 alone, thus offering a means to alter the sound characteristic of the total system by varying the distance between 12 and 36 when the legs 18 are adjusted within their corresponding guide/shaft 17, thereby enhancing certain parts of the lower frequencies in the sound reproduction range.

Another object is to provide an adjustment to allow variation of the distance from the cylinder port's exhaust and the floor/table/earth or other resting surface, The four legs 18 can be adjusted to provide both a means to accommodate different textured resting surfaces, such as grass or carpet, both from the standpoint of preventing the port exhaust from being blocked and also to vary the volume of air trapped under the unit which will have an effect an the tonal quality.

Another object is to provide a collapsible structure such that the bulk of the unit can be further reduced when the unit is not in use making convenient for transporting, packing in luggage, etc. where this is accomplished by adjusting the degree of engagement between legs 18 with leg tracks 17. Increased engagement results in greater compactness.

In the preferred embodiment the legs will have external threads and adjust by screwing into tubular channels 17 with an internal thread or, alternately, a leg having pin/key 18K which locks into any of several detents in the tubular channels 17. The legs thus screw or slide into the main enclosure and will hold the position set by the player. All 4 legs are individually adjustable, which allows leveling of the unit to suit uneven surfaces.

Another benefit of having legs on this small and shallow enclosure is that 2 of the legs can be fabricated with hook like extensions 18H at the leg end which allows the entire unit to be hung from the player's trouser waistband or belt eliminating the need for a should strap in venues where it would be useful for the musician to quickly walk to a different location such as a different table in a restaurant. However, maximum benefit from the novel enclosure is achieved when placed on a firm hard planar surface such as a floor.

Another object of this design is to provide the smallest possible bulk, yet still hold a battery supply (two 4-cell battery holders 14) which can provide both a high enough voltage to accommodate a variety of amplifier circuits and with sufficient current capability to yield high power, good bass response, and long battery life between recharge or battery replacement when of the most common variety batteries, the AA/UM-3 type. This battery type is long and slender in shape and fit well in the shallow of main cabinet 12 by laying them on their sides. In the preferred embodiment the small enclosure accommodates 8 batteries of this type resulting 10-12 volts while supplying a fairly high current supply.

In the preferred embodiment, if desired, the enclosure panel which the cylinder attaches sturdy foundation even though the opposite panel, which has hole 12F, may be fabricated from flexible material if the sympathetic vibration of such a flexible material on the top cabinet panel, as described by Campbell, are desired. This utilization of a rigid material for main enclosure 12 bottom panel and 12R is useful since in conventional loudspeaker cabinet design practice, the panel to which the speaker is bolted 12B (the baffle) is fabricated to be extremely rigid and will accomplish this function by itself. In the preferred embodiment the panel to which the cylinder is attached is fabricated from a more rigid material allowing the speaker to be held motionless by the ring gripping it. In this way the rear panel of the enclosure, and not the front, acting in conjunction with the cylinder replace this particular function of the convention speaker baffle.

In the preferred embodiment of the invention the slit that extends the full length of the cylindrical housing section would take some horizontal path 3D somewhere near the middle of it height to prevent the torque applied to the spilt cylinder when it is compressed at only one of its ends when its tapered thread is screwed into the chamfered hole in the main housing section from causing it to open at the opposite end and thereby losing contact with the speaker magnet. This also could also be corrected by adding a band which holds this end of the cylinder closed. A slit whose path creates a horizontal arrow 13S is one slit path that might be used. Another method would be a set horizontal pins on one side of the slit and a matching set of holes on the other slit's opposite side.

In general the enclosure should be as devoid of air leaks as possible, so that that all air is forced to flow through cylinder rib openings 13O, and extract the maximum benefit from the novel enclosure design.

A door to access the batteries for replacement can be incorporated, and should be designed to be completely airtight. However, such a door is unnecessary if rechargeable batteries are used and an airtight power jack can be incorporated to allow the electrical connection of an external battery charger. It is (safely) assumed that the instrument input jack 20 will not be a substantial air leak, since when in operation, the plug which connects the musical instrument will always be inserted and therefore, close the hole.

Operation

The invention's principal mode of operation and the way it is primarily, although not exclusively, intended to be used is with the legs 18 extended and locked and placed on a table 36 supported by the legs as shown in FIGS. 1 and 2. The electronic instrument, typically an electric guitar, is connected to the invention's input jack using a conventional guitar cable. Sound is projected from the upward facing loudspeaker 11 and also reflected off the table 36 on which the amp is supported, since sound energy is passed downward between the downward facing loudspeaker magnet 11M and enclosure extension (13 or 31). For transport, the legs are conveniently retracted to reduce the amplifier's bulk.

The invention may also be played be the player while he is standing by extending the hooked legs and hooking them over the player's pants belt. The volume produced when used this way will be somewhat less than that achieved when operated on a hard surface such as a table or floor, because sound energy emanating from the cabinet extension (13 or 31) will be absorbed by the soft surfaces of the player and his clothing.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Drawing part number global reference number

| number | part short name |
|---|---|
| 11 | loudspeaker |
| 11M | loudspeaker magnet |
| 11D | loudspeaker diaphragm |
| 11F | loudspeaker's frame |
| 12 | Main enclosure |
| 12B | Cabinet baffle |
| 12R | Cabinet rear opening |
| 13 | Cabinet extension |
| 13H | Threads of cabinet Extension |
| 130 | Opening between ribs of cabinet extension |
| 13R | Rib on cabinet extension |
| 13S | Slit in cabinet Extension |
| 14 | (X2) battery holder |
| 15 | electronics PCB |
| 16 | battery holder rest |
| 17 | leg guide X(4) |
| 17T | leg guide track |
| 18 | leg |
| 18K | leg key |
| 18H | leg hooks |
| 20 | Instrument input jack |
| 25 | Acoustic port of magnet and enclosure extension |
| 27 | Amplifier electronics control/switch |
| 29 | Speaker Mounting screws (4x) |
| 30 | battery |
| 31 | Tabbed enclosure extension |
| 31K | tension knob for tabbed cabinet extension |
| 31R | Rib of tabbed cabinet extension |
| 31S | Slit of tabbed cabinet Extension |
| 31T | Tab of tabbed cabinet extension |
| 33 | Space between cabinet and table/floor surface |
| 35 | Magnet protective rear cover |
| 3SF | Magnet protective cap ferrous metal |
| 36 | Table or floor |

What is claimed is:

1. A portable amplifier speaker comprising a housing consisting of two sections wherein a first section, the main enclosure, is a rectilinear hollow box having two circular openings said circular openings are exactly diametrically opposed, and a second section is a cylindrical tube, and having means to connect said cylindrical tube to the main enclosure in an airtight manner at one of the main enclosure's two circular openings, said cylindrical tube having evenly spaced ribs on the inner surface and having a slit which traverses the full length of said cylindrical tube;

an electronic amplifier and battery power supply each mounted entirely within the main enclosure;

a loudspeaker consisting of sections A and B where A is comprised of the loudspeaker frame and diaphragm and where B is comprised of the loudspeaker magnet assembly and where A is mounted at the circular opening of the main enclosure which is opposite to the circular opening of the main enclosure to which said cylindrical tube is connected and where said loudspeaker extends into the cylindrical tube such that A is fully enclosed within the main enclosure and only B is fully enclosed within the cylindrical tube of the housing.

* * * * *